United States Patent [19]

Kaplan

[11] Patent Number: 4,638,915

[45] Date of Patent: Jan. 27, 1987

[54] GLOVE HOLDER FOR DISH DRAINER

[76] Inventor: Mitzi Kaplan, 280 Argyle Rd., Brooklyn, N.Y. 11218

[21] Appl. No.: 791,931

[22] Filed: Oct. 28, 1985

[51] Int. Cl.[4] ..... A47F 7/00

[52] U.S. Cl. ..... 211/13; 223/78

[58] Field of Search ..... 211/13, 181, 119; 223/78, 79, 80

[56] References Cited

U.S. PATENT DOCUMENTS

| | | | |
|---|---|---|---|
| D. 25,538 | 5/1896 | Peabody | 223/78 X |
| 1,221,165 | 4/1917 | Gilliam . | |
| 1,319,579 | 10/1919 | Gillam | 223/78 |
| 1,733,680 | 10/1929 | Turner . | |
| 2,123,523 | 7/1938 | Clyde . | |
| 2,163,865 | 6/1939 | Bitney | 211/181 X |
| 3,096,008 | 7/1963 | Schumacher . | |
| 3,133,682 | 5/1964 | Sawyer | 211/13 X |

FOREIGN PATENT DOCUMENTS

| | | | |
|---|---|---|---|
| 801335 | 4/1936 | France | 223/80 |
| 113906 | 6/1917 | United Kingdom | 223/78 |

*Primary Examiner*—Ramon S. Britts
*Assistant Examiner*—Sarah A. Lechok Eley
*Attorney, Agent, or Firm*—Baxley, Charles E.

[57] ABSTRACT

Disclosed herein is a glove holder comprising a unitary member having a first portion configured to receive a rubber glove thereover and a second portion configured to engage a wire dish drainer selectively in either an upright, glove drying position or an inconspicuous folded down position.

4 Claims, 3 Drawing Figures

GLOVE HOLDER FOR DISH DRAINER

BACKGROUND OF THE INVENTION

This invention relates to glove holders for use with dish drainers and more particularly to a glove holder for receiving a rubber glove thereover and for releasably engaging a wire dish drainer in such a manner that the form can be positioned upright or folded away inconspicuously.

Wire dish drainers (typically coated with non-rustable plastic material) are widely used in the dish washing operation. Many people wear rubber gloves while washing dishes. There is a problem as to where to put the wet rubber gloves at the conclusion of the dish-washing operation.

It is an important object of the invention to solve the above stated problem.

Another object is to provide a simple inexpensive glove holder which is releasably engageable with a dish drainer and which is selectively positionable in either an upright, glove drying position or an inconspicuous folded down position. Other objects and advantages will appear hereinafter.

SUMMARY OF THE INVENTION

The inventive glove holder comprises a unitary member having a first portion configured to receive a rubber glove thereover and a second portion configured to engage a wire dish drainer selectively in either an upright, glove drying position or an inconspicuous folded down position.

DESCRIPTION OF THE PREFERRED EMBODIMENT

Figure 1:
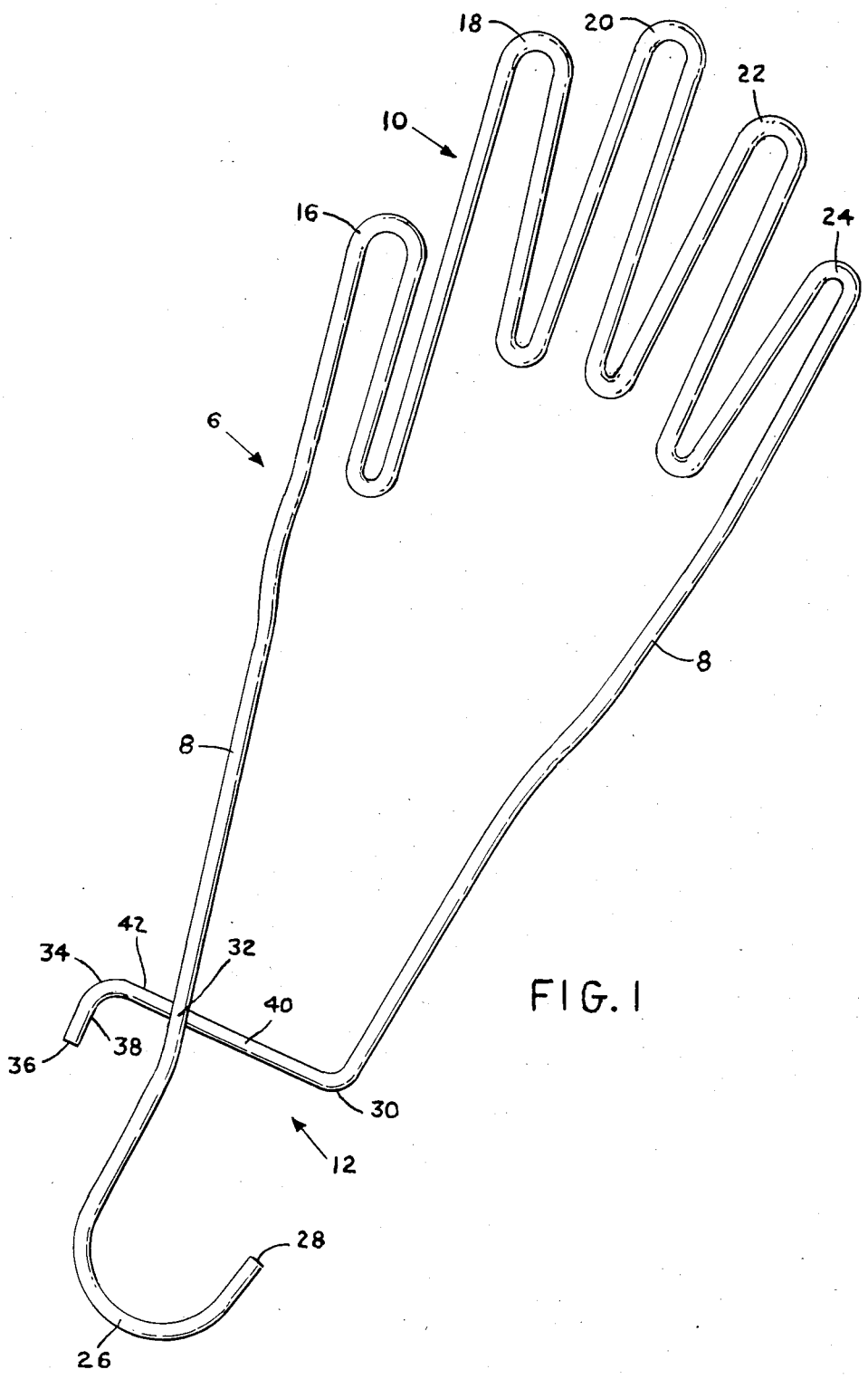
FIG. 1 is a plan view of a preferred glove holder embodying the invention.

FIG. 1 shows in plan view a glove holder 6 embodying the invention. Glove holder 6 comprises a unitary member which will be described hereinafter without limitation as a wire 8.

Wire 8 is made of spring metal, a suitable example of which is steel. If the material of wire 8 is subject to rust, wire 8 is preferably coated with non-rustable material, suitable examples of which include certain plastics well known in the art.

Figure 2:
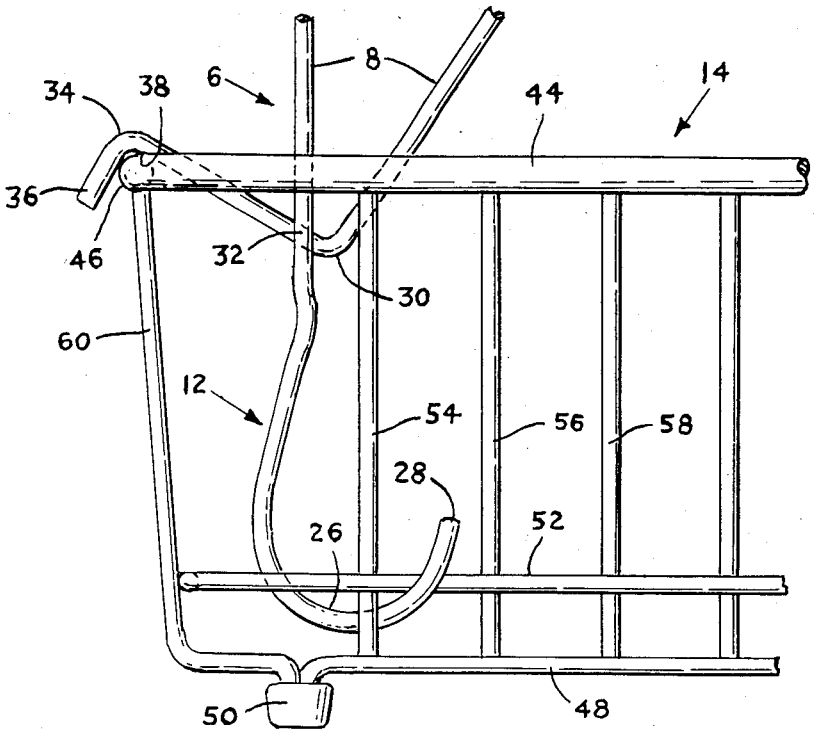
FIG. 2 is a fragmentary elevational view showing the glove holder of FIG. 1 engaging a dish drainer with the glove holder in its upright, glove drying position.
Figure 3:
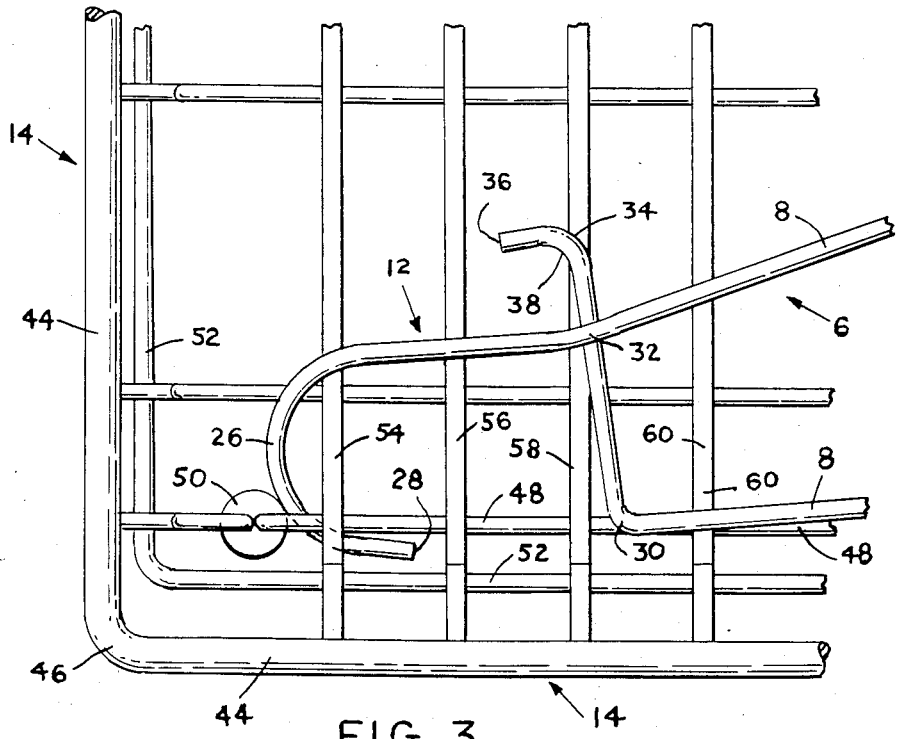
FIG. 3 is a fragmentary plan view of the glove holder of FIG. 1 engaging the dish drainer of FIG. 2 with the glove holder in its folded down position.

Glove holder 6 has a first portion 10 configured to receive a rubber glove (not shown) thereover and a second portion 12 configured to engage a wire dish drainer 14, which is fragmentarily shown in FIGS. 2 and 3.

The axis of wire 8 lies substantially in a plane, and the diameter of wire 8 is about 0.1 inch (0.254 cm).

Wire 8 is provided with five loops in first portion 10 corresponding with the thumb and fingers of the glove, as indicated at 16, 18, 20, 22 and 24. Wire 8 extends from thumb loop 16 and little finger loop 24 to second portion 12. Loops 16 and 24 provide holder 6 with extreme loops.

Second portion 12 includes a first hook 26 generally facing first portion 10. Hook 26 is of semi-circular form having an inside diameter of about 1.5 inches (4.21 cm). Hook 26 is formed in the part of wire 8 extending from thumb loop 16 and terminates at a first end 28 of wire 8.

The part of wire 8 extending from little finger loop 24 is bent at a first right angle 30 in second portion 12 and crosses at point 32 the part of wire 8 extending from thumb loop 16. When glove holder 6 is unstressed, the distance from right angle 30 to point 32 is about 1.5 inches (4.21 cm) and wire 8 is bent at a second right angle 34 about 2 inches (5.08 cm) from first right angle 30.

Also in second portion 12, wire 8 terminates at a second end 36 about 0.6 inch (1.5 cm) beyond right angle 34. The part of wire 8 between right angle 34 and end 36 provides second portion 12 with a second hook 38 facing generally away from first portion 10.

Due to the springiness of wire 8, point 32, where wire 8 crosses itself, shifts as the part of wire 8 extending from thumb loop 16 and the part of wire 8 extending from little finger loop 24 are squeezed together. During the shifting of point 32, wire 8 slides along itself, to alter the spacing between hooks 26 and 38.

It should be noted that, instead of as shown and described above, wire 8 could extend from thumb loop 16 to hook 38 and from little finger loop 24 to hook 26.

Thus, wire 8 presents in portion 12 a straight part 40 extending from right angle 30 to right angle 34.

FIGS. 2 and 3 illustrate fragmentarily glove holder 6 in engagement with dish drainer 14, FIG. 2 showing holder 6 in its upright, glove drying position and FIG. 3 showing holder 6 in its inconspicuous folded down position. Drainer 14 is seen in FIG. 2 from its outside, looking in.

Drainer 14 has an upper wire rail 44 extending therearound, there being four corners 46, one of which is visible in each of FIGS. 2 and 3. Drainer 14 further has, in a plane parallel to the plane of rail 44, a lowermost wire rail 48 provided with a bumper 50 and an intermediate wire rail 52, in a plane between the planes of rails 44 and 48. Joining rails 44, 48, and 52 are spaced posts 54, 56, 60, etc., it being noted that post 54 is that post closest to a corner 46.

To mount glove holder 6 in its upright, glove drying position, end 28 is passed, from inside drainer 14, underneath rail 52 and inside post 54 and then outside rail 52, so that hook 26 engages rail 52 and post 54. The parts of wire 8 leading to hooks 26 and 38 are then squeezed together and hook 38 placed in engagement with rail 44 on the other side of corner 46 from post 54. Upon releasing holder 6, it will be held in its upright, glove drying position as shown in FIG. 2.

When it is thereafter desired to place holder 6 in its inconspicuous folded down position, the parts of wire 8 leading to hooks 26 and 38 are squeezed slightly together to release hook 38 from rail 44 and holder 6 is laid down in drainer 14 as seen in FIG. 3.

Drainer 14 can thereupon be either left on the sink drainer board or hung under the sink, with holder 6 therein as shown in FIG. 3.

Holders 6 will normally be used in pairs and two holders 6 are readily accommodated in either position in a single drainer 14.

Due to the flat nature of holders 6, packaging thereof is greatly facilitated.

Other suitable materials for the unitary member which is described above as wire 8 will occur to those skilled in the art.

Glove holder 6 achieves all of the stated objects and advantages and others.

The disclosed details are exemplary only and are not to be taken as limitations on the invention except as those details may be included in the appended claims.

What is claimed is:

1. A glove holder comprising a unitary member having a first portion configured to receive a rubber glove thereover and a second portion configured for releasable engagement with a wire dish drainer to hold said glove holder selectively in either an upright, glove drying position or an inconspicuous folded down position, said member having five loops in said first portion corresponding with the thumb and fingers of said glove, the thumb loop and the loop for the little finger providing said holder with two extreme loops and said member extending to said second portion from said extreme loops, said second portion including a first open hook formed in the part of said member extending from one of said extreme loops and a second open hook formed in the part of said member extending from the other of said extreme loops, said hooks being located at the ends of said member with said first hook generally facing said first portion and said second hook generally facing away from said first portion, said hooks providing means for releasably engaging therebetween wires of said wire dish drainer to hold said glove holder in said upright, glove drying position and at least one of said hooks providing means to hold releasably a wire of said dish drainer to hold said glove holder in said folded down position.

2. A glove holder according to claim 1 wherein the part of said member extending to said second hook has a first substantially right angle bend in said second portion and crosses the part of said member extending to said first hook at a point and has a second substantially right angle bend providing said second hook, such that said first and second right angle bends are on opposite sides of said point.

3. A glove holder according to claim 2 wherein said member is a spring metal wire and said point shifts, with said wire sliding along itself, as the parts of said wire extending from said extreme loops are squeezed together, thus to alter the spacing between said hooks.

4. A glove holder according to claim 3 wherein said wire of said holder is coated with non-rustable plastic material.

* * * * *